United States Patent [19]

Vecht et al.

[11] 4,140,937

[45] Feb. 20, 1979

[54] DIRECT CURRENT ELECTROLUMINESCENT DEVICES

[76] Inventors: Aron Vecht, 95, Corringham Rd., London NW11 7DL; Raymond Ellis, 85, Cutlers Pl., Wimbourne, Dorset, BH21 2HX, both of England

[21] Appl. No.: 707,580

[22] Filed: Jul. 22, 1976

[30] Foreign Application Priority Data

Jul. 22, 1975 [GB] United Kingdom ..... 30590/75

[51] Int. Cl.[2] ..... H05B 33/02; H05B 33/26

[52] U.S. Cl. ..... 313/503; 29/25.11; 313/509

[58] Field of Search ..... 313/506, 509, 503, 498; 29/584, 25.11

[56] References Cited

U.S. PATENT DOCUMENTS

| | | | |
|---|---|---|---|
| 3,295,002 | 12/1966 | Amans | 313/503 |
| 3,315,111 | 4/1967 | Jaffe et al. | 313/503 |
| 3,414,490 | 12/1968 | Thornton, Jr. | 313/509 X |
| 3,854,070 | 12/1974 | Vlasenko et al. | 313/509 X |

FOREIGN PATENT DOCUMENTS 1300548 12/1972 United Kingdom.

OTHER PUBLICATIONS

IBM Technical Disclosure Bulletin, vol. 17, No. 1, p. 286, Jun. 1974, Article Entitled "Field-Effect Viewing Storage Panel Configuration with High-Resolution Capabilities," by Pennington et al.

*Primary Examiner*—Palmer C. Demeo

*Attorney, Agent, or Firm*—Pollock, Vande Sande & Priddy

[57] ABSTRACT

In an electroluminescent device comprising a layer of electroluminescent material disposed between a pair of electrodes, and a transparent substrate, the electrode between the substrate and the layer of electroluminescent material is transparent and has a surface portion remote from the substrate having properties substantially confining current flow therethrough to discrete regions thereof. In one form the transparent electrode has a first layer adjacent the substrate of electrically-conductive material and a second layer of semiconducting or insulating material. In another form of the transparent electrode this electrode is of a metal oxide and the discrete regions are in a substantially pure form of that metal.

36 Claims, 6 Drawing Figures

Fig.1.
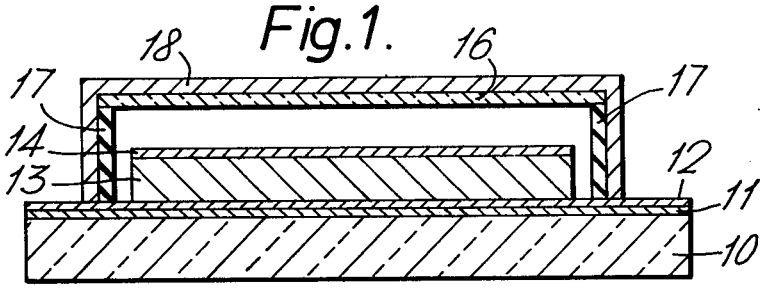
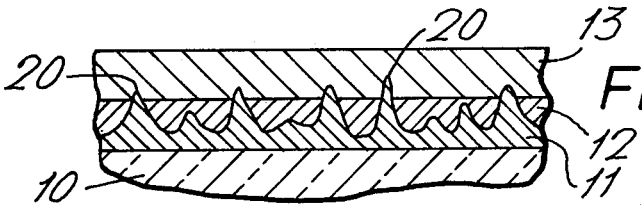
Fig.2.
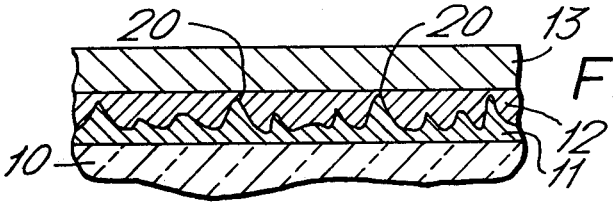
Fig.3.
Fig.4.
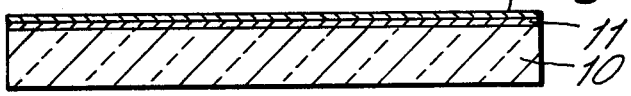
Fig.5.
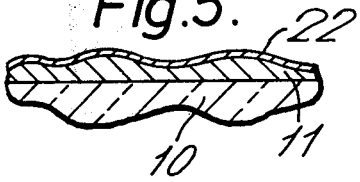
Fig.6.
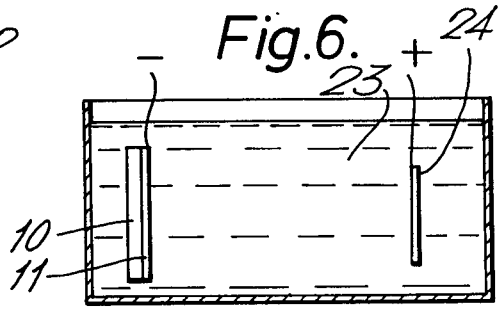

DIRECT CURRENT ELECTROLUMINESCENT DEVICES

BACKGROUND OF THE INVENTION

This invention relates to electroluminescent devices and, more particularly, to assemblies for use in electroluminescent devices and electroluminescent devices incorporating such assemblies.

Such electroluminescent devices may be constructed by depositing on a surface of a transparent substrate of, for example, glass, a transparent layer of an electrically-conductive material such as tin oxide. The unwanted portions of this layer are then removed to provide an electrode of the desired configuration having areas defining the regions of the electroluminescent device which may be required to emit light, a conductive strip adjacent an edge of the substrate and leads appropriately connecting the conductive strip to the said areas of the electrode. The electroluminescent layer is applied to the exposed surface of the electrode in the form of paint comprising an electroluminescent powder mixed with a suitable binder. After curing or drying of this paint, it is covered by an electrically-conductive layer of, for example, aluminum to provide the other electrode of the device and the device is then encapsulated for protection purposes. At this stage the device will not emit light and to cause such electroluminescent it must undergo a forming process which changes appropriately the structure of the electroluminescent layer. This is achieved by applying a unidirectional voltage to the device using a transparent layer as the positive electrode until the required structure is provided, causing the resistance of specific portions of the electroluminescent layer to increase, the current flow to fall and light to be emitted from the said regions. Thereafter the application of a suitable relatively low voltage across the electrodes will cause immediate emission of light.

The function and construction of the electroluminescent layer, the process used to form the electroluminescent layer and the operation of the electroluminescent devices have been described in detail in a number of articles and other publications. Two such articles are; "Direct-Current Electroluminescent in Zinc Sulphide : State of the Art" in Proceedings of the IEEE, Vol. 61, No. 7, July 1973 at pages 902 to 907, and an article entitled "Materials control and d.c. electroluminescence in ZnS: Mn, Cu, Cl powder phosphors" in Brit. J. Appl. Phys. (J. Phys.D), 1969, Ser. 2, Vol. 2, at pages 953 to 966.

Typical forming currents are in the region of 100mA/sq.cm. with voltages of the order of 15 to 80 volts depending upon the construction and shape of the layers of the device and, in particular, the shape of the transparent electrode. For example, higher forming voltages are necessary especially when the transparent electrode has relatively long leads connecting its conducting strip to the areas of that electrode defining the light emitting regions of the device, and in these circumstances the heat dissipated in the connecting leads can cause overheating and/or cracking of the substrate, especially when the light emitting regions are relatively large, as well as burning of the transparent electrode and the electroluminescent layer.

SUMMARY OF THE INVENTION

It is an object of the present invention to provide an electroluminescent device in which the said forming thereof can be achieved with relatively lower power and, in particular, substantially lower currents.

According to one aspect of the present invention there is provided an assembly for use in electroluminescent devices comprising a transparent substrate and a transparent electrode disposed on the substrate, the electrode having a surface on which is to be disposed a layer of electroluminescent material which is capable of conducting electric current, and wherein the electrode has a surface portion remote from the substrate having properties substantially to confine current flow therethrough to discrete regions thereof.

It has been found that by providing such remote surface portion, less electric power than aforesaid is required to form the electroluminescent material, thereby reducing the risk of damaging the substrate, the electroluminescent material, and the transparent electrode during the said forming process.

The remote surface portion may be at least partially of a semiconducting or insulating material. It also may have characteristics such that it will substantially inhibit the flow of impurities therethrough.

The electrode may comprise a first layer of electrically-conductive material adjacent the substrate and a second layer of semiconducting or insulating material. In these circumstances, the second layer may have apertures therein defining the said discrete regions. Alternatively, the second layer may completely cover the first layer.

In another form of the assembly the electrode comprises a metal oxide, the discrete regions thereof being in a substantially pure form of that metal. The metal oxide may be doped, the level of such dopant in the said surface portion of the electrode being different from that in the remainder of the electrode.

According to a further aspect of the present invention there is provided an electroluminescent device comprising an assembly in accordance with the said one aspect of the present invention, a second electrode and a layer of electroluminescent material disposed between the electrodes.

BRIEF DESCRIPTION OF THE DRAWINGS

Three forms of direct current electroluminescent devices and assemblies for use therewith, in accordance with the present invention will now be described, by way of example, with reference to the accompanying drawings in which:

FIG. 1 is a sectional side view of a first form of the electroluminescent device;

FIGS. 2 and 3 are fragmentary sectional views used to explain different constructions of the first form of the device;

FIG. 4 is a sectional side view of an assembly used in the manufacture of a second form of the device;

FIG. 5 is a fragmentary sectional view used to describe the second form of the device; and FIG. 6 is a diagram to explain a method of manufacturing a third form of the device.

BRIEF DESCRIPTION OF THE PREFERRED EMBODIMENT

Referring to FIG. 1, the direct current electroluminescent device includes a transparent substrate 10 of glass or a polymeric material on one surface of which is provided a transparent electrically-conductive layer 11 to form the positive electrode for the device. The layer 11 may be of, for example, tin oxide doped with antimony, indium oxide, titanium dioxide, cadmium oxide doped with tin, cadmium stannate, or bismuth oxide coated with gold. The tin oxide layer 11 may be formed by any of the known processes such as evaporation, sputtering or chemical vapour deposition. Alternatively, electrolytic processes may be used to form the layer 11 by anodising a metal layer deposited on the substrate 10. The unwanted portions of the layer 11 are then removed by a conventional etching process to provide an electrode having areas defining the regions of the electroluminescent device which may be required to emit light, one or more conductive strips adjacent the edges of the substrate 10 and conductive tracks appropriately interconnecting the said electrode areas and the conductive strip(s).

Thereafter, in order to permit the forming process to be achieved with reduced electric power, there is formed on the exposed surface of the electrode layer 11, by an evaporization process, a continuous layer 12 of copper sulphide. The thickness of the layer 12 is less than 5 mircon and preferably of the order of 1 micron.

Various other semiconducting or insulating materials may be used to constitute the layer 12. For example, this layer may be of zinc sulphide, copper oxide, zinc oxide, copper selenide, zinc selenide, aluminium oxide, silicon monoxide or Yttrium oxygen sulphide. The layer 12 is preferably one having a work function between 2ev and 6ev.

The layer 12 is covered by electroluminescent layer 13 of a powder phosphor mixture having a thickness of the order of, for example, 30 to 50 microns. This mixture comprises phosphor particles individually coated with copper and mixed with a binder, the mixture being painted on to the layer 12 to the required thickness and then cured or allowed to dry. More particularly, this mixture is of the kind described in the articles referred to previously.

When this has been completed, an electrically-conductive material of, for example, aluminium or copper is formed on the exposed surface of the electroluminescent layer to provide a layer 14 constituting the other electrode for the electroluminescent device.

As shown in FIG. 1, the subsrate 10, the electrode 11 and the layer 12 projects beyond the electroluminescent layer 13 and the electrode 14 to provide a step with the upper surface of the layer 12 exposed. The electroluminescent layer 13 and the electrode 14 are covered by a sheet 16 of glass mounted on strips 17 of butyl rubber which are in turn mounted on the layer 12 to define a closed volume in which the electroluminescent layer 13 and the electrode 14 are disposed. A dessicant is disposed within this volume and the external surfaces of the sheet 16 and the strips 17 are covered by layer 18 of a suitable encapsulation material.

At this stage, the electroluminescent device will not emit light when a direct voltage is applied to the electrodes constituted by the layers 11 and 14 and it is necessary to form the electroluminescent layer 13. To this end, a unidirectional voltage is applied to the device using the layer 11 as the positive electrode and the layer 14 as a negative electrode to cause the required structure to be provided in the electroluminescent layer 13. At this time, the resistance of the electroluminescent layer 13 increases, the current flow through the layer 14 decreases and light is emitted from the said regions of the layer 14 defined by the layer 11. Thereafter the application of a suitable relatively low unidirectional voltage of continuous or pulsed form will cause immediate emission of light by the device. Conveniently, when pulses are used, the pulses have a mark-to-space ratio of the order of 1 to 200 and a repitition frequency of the order of 125KHz.

By providing between the electrode layer 11 and the electroluminescent layer 13, the layer 12 (which effectively constitutes an additional layer of the electrode), it has been found that less electric power is required to form the electroluminescent layer. As a result the risk of overheating and damaging of the substrate 10 and the layers 11 and 13 during the forming process, as hereinbefore described, is substantially reduced. It has been found that this is due to the fact that the semiconducting or insulating layer 12 tends to modify the surface portion of the electrode 11 and confine the current flow into the surface of the electrode layer 11 to discrete regions thereof. These regions may be very small, having, say, a maximum cross-sectional dimension of the order of a few microns but this dimension may be as low as 1/10 micron or even lower.

The surface of the electrode 11 remote from the substrate 10 is undulating, having peaks which project towards the electroluminescent layer 13, and the continuous layer 12 may be of the two different forms shown in FIGS. 2 and 3. In FIG. 2, the continuous layer 12 covers only the minor peaks provided by the undulating surface of the electrode 11 and has apertures through which major peaks 20 of the electrode 11 extend and electrically engage with the electroluminescent material. In this form the current flow is confined to the peaks 20. In the form of FIG. 3 the continuous layer 12 completely covers the electrode 11 and the layer 12 serves to confine the current flow to the discrete regions by providing a blocking contact between the electrode 11 and the electroluminescent layer 13. The thin resistive regions of the layer 12 between the electroluminescent layer 13 and the major peaks 20 of the layer 11 constitute the discrete regions and provide preferential high field regions on the initial application of the forming voltage between the electrodes 11 and 14.

It has further been found that the layer 12 also serves to increase the life of the electroluminescent devices by inhibiting diffusion into the electroluminescent layer 13 of impurities in the substrate 10 and the electrode 11.

Although the insulating or semiconducting material constituting the layer 12 may be of many different forms, this material may be any metal chalcogenide compound, the metal of the compound being different from the metal in the electrode 11 and being compatible with the electroluminescent material. More particularly, the material of the layer 12 is a metal chalcogenide compound from the group consisting of oxygen, sulphur and selenium.

Although in this particular form of the electroluminescent device the semiconducting or insulating layer 12 is formed separately from the layer 11, it is visualised that the layers 11 and 12 may be integral with one another. For example, the transparent electrode 11 may be deposited on the substrate 10 and then be treated so as appropriately to change the properties of the surface of the layer 11 remote from the substrate 10 so that that surface of the layer 11 exhibits the properties or characteristics of the layer 12. Alternatively the layer 11 may be formed in two distinct steps, the first step involving the forming on the substrate 10, by, for example, deposition, of a first part of the layer 11 having the necessary properties to provide a transparent electrode for the device, and the second step involving the forming of the other part of the layer 11 under the necessary conditions so that the surface portion of the layer 11 formed in this latter step has the properties or characteristics previously provided by the separate layer 12.

In the second form of the electroluminescent device, a layer 11 of tin oxide doped with antimony is formed on the glass substrate 10 and layer of aluminium is then evaporated into the surface of the layer 11. This is shown in FIG. 4 in which the layer of aluminium is referenced 21. This layer 21 is then removed using a solution of stannous chloride by immersing the device in the solution. It has been found that during the removal of the aluminium layer 21, an insulation layer of aluminium oxide is formed on the surface of the tin oxide. This insulating layer is shown at 22 in FIG. 5, the layer 22 completely covering the electrode 11 and being of constant thickness.

In a third form of the electroluminescent device a layer 11 of tin oxide doped with antimony is formed on the glass substrate 10 and the so-formed device is then immersed in an electrolyte 23 as shown in FIG. 6 of, for example, tap water or a slightly acidified, distilled water. The tin oxide layer 11 is connected to a negative electrode of a power supply source (not shown) whose positive electrode is connected to an electrode 24 immersed in the electrolyte to cause an electrolyte current to flow from the electrode 24 to the layer 11. The electrode 24 is of a suitable inert material such as graphite, platinum or tin oxide.

It has been found that during both the removal of the aluminium layer 21 and the electrolytic action used in the second and third forms of the electroluminescent device, discrete portions of the tin oxide layer 11 adjacent the surface thereof remote from the substrate 10 are reduced to tin to form the said discrete regions within which the current is substantially confined during the said forming process. Furthermore it is believed that during both of the reduction processes of the second and third forms of the device, the ratio of antimony dopant in the surface of the layer 11 remote from the substrate 10 is changed to form an insulating surface portion on the layer 11 which seeks to inhibit the flow of impurities into the electroluminescent layer 13 from the substrate 10 and the layer 11. Also in the second form of the device, this flow of impurities is further inhibited by the insulation layer 22 of aluminium oxide.

When the methods of the second and third forms of the device have been completed, the electroluminescent and conductor layers 13 and 14 are formed as previously described.

The regions of the electroluminescent devices which are to be illuminated may be excited simultaneously or sequentially. In the former case the areas of the layer 11 defining the said regions are each connected by conductive tracks to a conductive strip provided adjacent the edge of the substrate 10.

In the latter case the conductive strip may be dispensed with, individual conductive tracks being provided for the said areas of the layer 11, the tracks extending to the edge of the device to permit individual connection of the tracks to respective terminals of a voltage supply source. However, when the areas of the layer 11 are to be excited in groups, conductive strips may be provided for each group with the areas being connected to appropriate ones of the strips by conductive tracks.

Although the invention has been described with reference to d.c. electroluminescent devices it will be appreciated that the invention is equally applicable to a.c. electroluminescent devices.

We claim:

1. An electroluminescent device comprising a multilayer assembly having a pair of electrodes and a layer of electrically-conductive electroluminescent material disposed therebetween, and a transparent substrate supporting the assembly with one of the electrodes disposed between the substrate and the layer of electroluminescent material wherein said one electrode is transparent, and means effective on a surface portion of said one electrode remote from the substrate for defining discrete regions within which current flow through said surface portion is substantially confined.

2. An electroluminescent device according to claim 1, wherein said means comprises a further layer of a semiconductive material on the surface of said transparent electrode adjoining said electroluminescent layer.

3. An electroluminescent device according to claim 1, wherein said means substantially inhibits the flow of impurities into said surface portion of said conductive layer.

4. An electroluminescent device according to claim 1, wherein said electrode comprises a first layer of electrically-conductive material adjacent said substrate and a second layer of semi-conducting or insulating material.

5. An electroluminescent device according to claim 4, wherein the second layer has apertures therein defining said discrete regions.

6. An electroluminescent device according to claim 5, wherein the first layer projects through the said apertures.

7. An electroluminescent device according to claim 4, wherein the second layer completely covers the first layer.

8. An electroluminescent device according to claim 7, wherein the second layer has a work function substantially between 2ev and 6ev.

9. An electroluminescent device according to claim 4, wherein the second layer comprises copper sulphide.

10. An electroluminescent device according to claim 4, wherein the second layer comprises zinc sulphide.

11. An electroluminescent device according to claim 4, wherein the second layer comprises copper oxide.

12. An electroluminescent device according to claim 4, wherein the second layer comprises zinc oxide.

13. An electroluminescent device according to claim 4, wherein the second layer comprises copper selenide.

14. An electroluminescent device according to claim 4, wherein the second layer comprises zinc selenide.

15. An electroluminescent device according to claim 4, wherein the second layer comprises aluminium oxide.

16. An electroluminescent device according to claim 4, wherein the second layer comprises silicon monoxide.

17. An electroluminescent device according to claim 4, wherein the second layer comprises yttrium oxygen sulphide.

18. An assembly according to claim 4, wherein the second layer has a thickness less than 5 microns.

19. An electroluminescent device according to claim 1, wherein said means comprises a surface portion on said one electrode which is of a semiconducting or insulating material.

20. An electroluminescent device according to claim 1, wherein the said transparent electrode comprises a first layer adjacent said substrate of an electrically-conductive material and a second layer of semiconducting or insulating material.

21. An electroluminescent device according to claim 20, wherein said second layer comprises a metal chalcogenide compound, the metal of that compound being different from the metal in the said first layer of the assembly and being compatible with the electroluminescent material.

22. An electroluminescent device according to claim 1, wherein said transparent electrode is of a metal oxide, the said discrete regions being in a substantially pure form of that metal.

23. An elecroluminescent electroluminescent according to claim 1, wherein said means comprises a further layer of an electrically insulating material on the surface of said transparent electrode adjoining said electroluminescent layer.

24. An electroluminescent device according to claim 1, wherein the electroluminescent material is of particulate form.

25. An electroluminescent device according to claim 1, wherein the material comprises particles coated with electrically-conductive material.

26. An electroluminescent device according to claim 25, wherein the electrically-conductive material is of metal.

27. An electroluminescent device according to claim 26, wherein the electrically-conductive material is of copper.

28. An assembly for use in electroluminescent devices comprising:

a transparent substrate, a transparent electrode on said substrate and formed at least in part of an electrically conductive layer, a layer of electrically conductive electroluminescent material supported on the surface of said electrode remote from said substrate, and means for confining current flow into a surface portion of said conductive layer to discrete portions thereof.

29. An assembly according to claim 28, wherein the said electrode comprises a metal oxide, the said discrete regions thereof being in a substantially pure form of that metal.

30. An assembly according to claim 29, wherein the metal oxide is doped, the levels of such dopant in the said surface portion of the electrode being different from that in the remainder of the electrode.

31. An assembly according to claim 29, wherein the surface of the electrode remote from the substrate is covered by a layer of insulating material.

32. An assembly according to claim 29, wherein the electrode comprises a transparent layer of tin oxide on the substrate so that the transparent layer has an exposed surface, and an aluminum oxide layer on said exposed surfce of the tin oxide layer.

33. An electroluminescent device comprising a substrate and a multi-layer assembly thereon, the assembly comprising a pair of electrodes and a layer of electrically-conductive electroluminescent material disposed therebetween, wherein one of the electrodes is transparent and has a surface portion on the side thereof, adjacent said layer of electroluminescent material defining discrete regions within which current flow through said surface portion is substantially confined.

34. An electroluminescent device according to claim 33, wherein said transparent electrode is in surface contact with said layer of electroluminescent material.

35. An electroluminescent device according to claim 33, wherein said substrate is transparent, and said transparent electrode is disposed between the transparent substrate and said layer of electroluminescent material.

36. A method of manufacturing an electroluminescent device which comprises the steps of: providing a transparent substrate, disposing on said substrate a first electrode which is transparent and has a surface portion defining discrete regions within which current is to flow through said surface portion, said disposing of said first electrode being accomplished in such a manner that said surface portion is remote from said substrate, disposing a layer of electrically-conductive electroluminescent material and a second electrode on said first electrode in a manner such that said electroluminescent material is disposed between said first and second electrodes, and applying between said first and second electrodes a unidirectional voltage to cause current to flow through said discrete regions of said surface portion of said first electrode to form the electroluminescent material and cause it to emit light.

* * * * *